United States Patent [19]

Wanner et al.

[11] 3,969,609

[45] July 13, 1976

[54] ILLUMINATED PUSH BUTTON SWITCH

[75] Inventors: Vernon Walter Wanner; William Karl Lueschen, both of Milwaukee, Wis.

[73] Assignee: Globe-Union Inc., Milwaukee, Wis.

[22] Filed: Jan. 15, 1975

[21] Appl. No.: 541,328

[52] U.S. Cl. ..... 200/314; 339/113 L

[51] Int. Cl.[2] ..... H01H 9/00

[58] Field of Search ..... 200/314, 280, 281, 51.16, 200/16 C, 16 D, 309, 113, 115–117; 339/113 L

[56] References Cited

UNITED STATES PATENTS 3,601,567 8/1971 Shah ..... 200/314

*Primary Examiner*—Gene Z. Rubinson
*Assistant Examiner*—M. Ginsburg
*Attorney, Agent, or Firm*—James L. Kirschnik; John Phillip Ryan

[57] ABSTRACT

An illuminated push button switch assembly has a self-contained light source and a switch portion having integral conductive terminals eminating therefrom. A removable nonconductive saddle is provided for mounting a pair of auxiliary conductive terminals on the switch assembly and connectors are provided for electrically coupling the light source to the auxiliary terminals when said saddle is in place or for coupling the light source to the switch terminals when said saddle is removed. The removable saddle enables switches to be uniformly constructed while having the flexibility of having the light source function either independently of or in conjunction with the activation of the switch.

9 Claims, 5 Drawing Figures

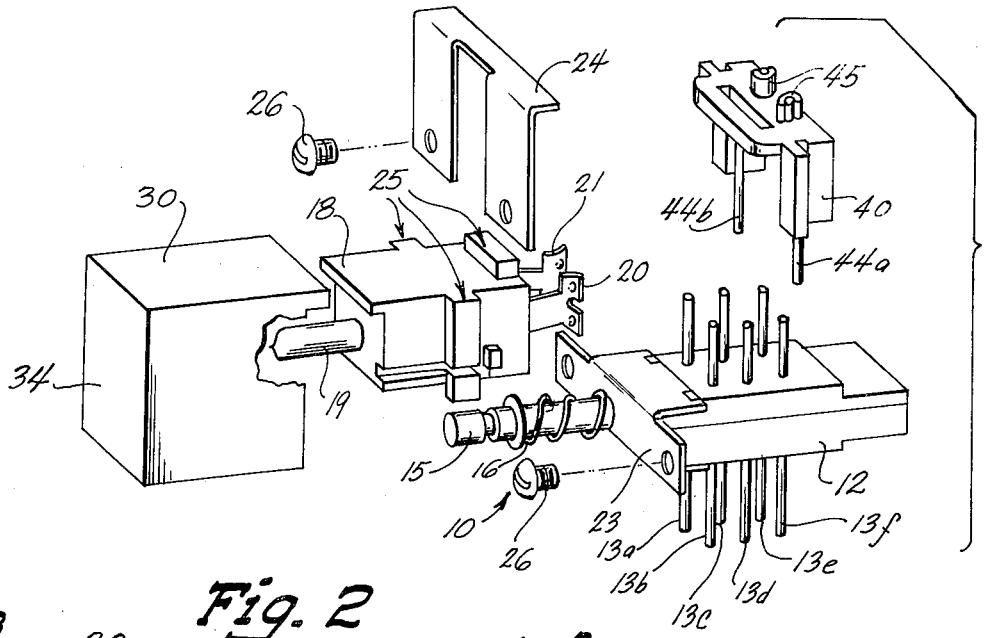
Fig. 1
Fig. 2
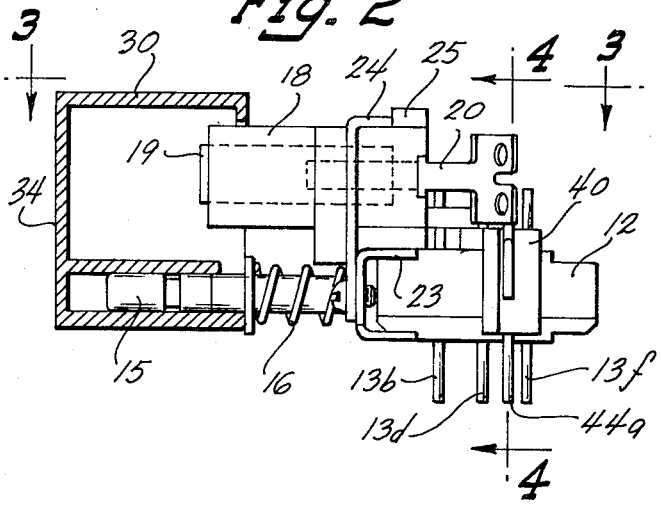
Fig. 3
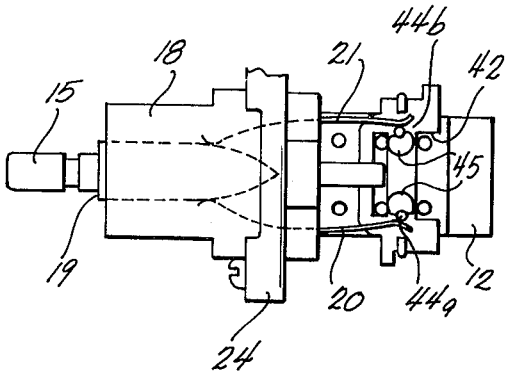
Fig. 4
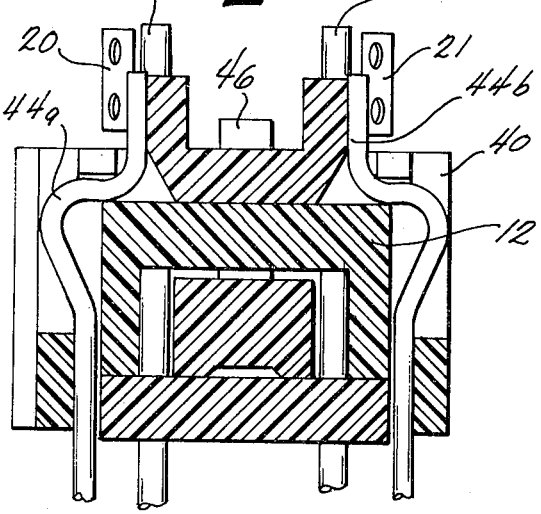
Fig. 5
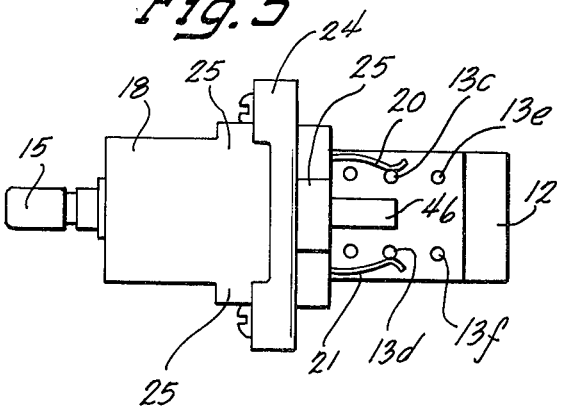

ILLUMINATED PUSH BUTTON SWITCH

BACKGROUND OF THE INVENTION

In many switch installations, it is desirable to have a switch which is illuminated. Some installations may prefer to have the switch illuminated only when the switch is in a certain selected mode, while in other installations it may be desired to have the switch illuminated constantly. Since a separate energizing circuit may be required for the light source in some cases, in order to provide for alternative switch applications in the past it has been necessary to provide alternate switch designs whereby one switch would be utilized for activation of the illuminating means with the switch in an "on" position only, for example, and another switch would be provided for constant illumination of the switch push button. A disadvantage of the prior art illuminated switches is that either separate switch designs are required or an additional pair of poles utilized. In addition, since the switches may often be quite similar in appearance, except for the internal electrical connections, they may be easily confused as to which type of function they perform.

SUMMARY OF THE INVENTION

It is an object of the present invention to provide an illuminated push button switch which may have uniform construction and be easily convertible to operate in several modes.

Other objects and advantages of the present invention will become apparent from a description of a preferred embodiment which follows.

Basically the invention comprises an illuminated push button switch having a self contained light source in conjunction with a switch assembly having a plurality of conductive terminals coupled therewith. A removable nonconductive saddle is provided for mounting a pair of auxiliary conductive terminals and the switch is constructed such that when the saddle and auxiliary terminals are in place the light source may be illuminated independently of the switch function, and when the saddle is removed the light source may be coupled to one or more of the switch terminals.

DESCRIPTION OF THE DRAWINGS

FIG. 1 is an exploded view in perspective of a switch constructed according to the invention;

FIG. 2 is a side elevational view of the assembled switch shown in FIG. 1:

FIG. 3 is a view taken along line 3—3 of FIG. 2;

FIG. 4 is a view taken along line 4—4 of FIG. 2; and

FIG. 5 is a view similar to FIG. 3 with the nonconductive saddle removed from the switch assembly.

DESCRIPTION OF THE PREFERRED EMBODIMENT

Referring to the drawing, an improved illuminated switch assembly 10 is shown which includes a single button two pole push-push-type switch 12 having terminals 13*a–f* extending therethrough. The switch 12 may be constructed according to U.S. Pat. No. 3,259,728 issued July 5, 1966 to Christian-Marie-Godefroy du Temple de Rougemont et al and may include an elongated selector shaft 15 slidably disposed within the housing of switch 12. Selector shaft 15 may be resiliently urged outwardly from switch 12 by a spring 16, and depending on the position of the selector shaft 15, two or more of the terminals 13*a–f* may be electrically connected. A housing 18 is provided which contains a light source such as a light bulb 19 which may be secured therein in contact with a pair of spaced upstanding connector members 20 and 21 which protrude from one end of housing 18. A first bracket 23 may be attached to the switch 12 and a second bracket or flange 24 may be provided for securing the housing 18 stationarily relative to switch 12. The bracket 24 may engage one or more bosses 25 formed on the housing 18 and bracket 24 may be secured to bracket 23 by any conventional means such as screws 26. As seen in the drawing, the housing 18 is secured by brackets 23 and 24 in a stationary position above the switch 12 with light 19 generally positioned above the selector shaft 15. The connectors 20 and 21 coupled to light 19 will extend rearwardly over the switch 12 in the vicinity of the upper extensions of terminals 13*a–f*. A button member 30 may be provided which has a generally hollow box-like construction and has a spaced horizontal partition for frictionally engaging the shaft 15. The back portion of button 30 is open to enable the button 30 to slide relative to housing 18 upon activation and movement of selector shaft 15 by pushing on button 30. The front wall 34 of button 30 may be of any translucent material so that when light 19 is illuminated it will be visually indicated through the front wall 34.

As seen in FIGS. 1–4, a generally U-shaped nonconductive saddle 40 is provided which is fitted to slide down over switch 12 with the legs of the U spanning the sides of switch 12. The upper portion of the member 40 may have a slot formed therein for receiving one pair of terminals 13*c* and 13*d* and a groove 42 may be formed in the rear portion of the saddle 40 for spanning terminals 13*e* and 13*f*. As is best seen in FIG. 4, a passageway is formed in either side of saddle 40 for receiving and carrying a pair of auxiliary wire terminal members 44*a* and 44*b*. A portion of the terminals 44*a* and 44*b* extend upwardly above the top surface of saddle 40 and the opposite ends of the terminals 44*a* and 44*b* extend downwardly parallel to and coextensive with the lower projections of terminals 13*a–f*. A pair of upstanding insulated lugs or bosses 45 are also formed on the upper portion of saddle 40, each having an arcuate notch formed therein for receiving the upper portions of terminals 44*a* and 44*b* to insulate them from terminals 13*c–f*. As seen in FIG. 3, the extensions of connectors 20 and 21 from housing 18 engage the upper portions of terminals 44*a* and 44*b* which hold the connectors 20 and 21 outwardly and spaced from terminals 13*c* and 13*d*. On the other hand, if saddle 40 is removed, connectors 20 and 21 may be bent inwardly so as to contact the upper portions of terminals 13*c* and 13*d* as seen in FIG. 5. A projecting member 46 may extend from the rear of housing 18 to retain saddle 40 in place.

From the foregoing description it will thus be apparent to those skilled in the art that the provision of saddle 40 in conjunction with the switch 12 and housing 18 permits the switch assembly to be utilized either with or without auxiliary terminals 44*a* and 44*b*. Thus, the same basic switch assembly may be provided for use in different circuits merely by adding or deleting the saddle 40 and terminals 44*a* and 44*b*.

In normal usage, the switch assembly 10 may be connected to a control panel (not shown) and lead wires coupled to the terminals 13*a–f*, or the terminals could be plugged into a printed circuit board. Assuming terminals 13*e* and 13*f* are energized, the switch could be utilized with the saddle 40 in place such that terminals 44*a* and 44*b* are energized continuously regardless of the switch mode whereby the light 19 will be illuminated at all times. On the other hand, if the saddle 40 is not utilized, terminals 20 and 21 may be positioned to contact connectors 13*c* and 13*d* and the light 19 will be illuminated only when the switch is in one selected mode. It will thus be appreciated that the present invention provides a switch which may be uniformly constructed and manufactured on a single production line and which may be functionally changed merely by the addition of saddle member 40 and auxiliary terminals 44*a* and 44*b*. The present invention eliminates confusion between similar appearing switches which have different functions and provides a switch which may be easily modified by adding or deleting the saddle 40 and terminals 44*a* and 44*b*.

While a single embodiment of the invention has thus been described in conjunction with a two pole switch, it will be apparent to those skilled in the art that any practical number of poles could be provided. Accordingly, the scope of the invention is to be taken solely by an interpretation of the claims which follow.

We claim:

1. An illuminated electrical switch comprising:

a switch mechanism having a selector element extending from one end and two or more conductive switch terminals located in proximity to the other end of said switch mechanism;

housing means coupled to said switch mechanism for containing a light source, said housing means including a socket for receiving said source located adjacent to said selector element and spaced conductive connector means engaging said light source, said connector means extending from said housing means and terminating in proximity to said switch terminals; and nonconductive saddle means removably mounted on said switch mechanism adjacent said housing means, said saddle means including pair of spaced auxiliary terminals spanning the sides of said switch mechanism and spaced from said switch terminals, said connector means contacting said auxiliary terminals and being held out of contact with said switch terminals when said saddle means is in place and contacting at least one of said switch terminals when said saddle means is removed.

2. The switch recited in claim 1, wherein:

said saddle means is generally U-shaped, the legs of said U spanning the sides of said switch mechanism, and said auxiliary terminals being mounted in said legs.

3. The switch recited in claim 2 wherein:

said housing means having a projection extending therefrom spaced from the top of said switch mechanism for retaining said saddle means in place on said switch mechanism.

4. The switch recited in claim 1 wherein:

said switch mechanism comprises a push button switch.

5. The switch recited in claim 4 wherein:

said switch terminals comprise spaced parallel members.

6. The switch recited in claim 2 wherein:

said saddle means having a slot formed in the base of said U for receiving at least two of said switch terminals.

7. The switch recited in claim 6 including:

button means mounted on said selector element, said button means having a translucent surface for visually indicating when said light source is on.

8. The switch recited in claim 7 wherein:

said saddle means having nonconductive projections engaging a portion of said auxiliary terminals at the point of contact with said connector means for insulating said auxiliary terminals from said switch terminals.

9. The switch recited in claim 5 wherein:

said housing means having a projection extending therefrom spaced from the top of said switch mechanism for retaining said saddle means in place on said switch mechanism.

* * * * *